United States Patent [19]

Siminoski et al.

[11] Patent Number: 4,915,785

[45] Date of Patent: Apr. 10, 1990

[54] SINGLE STAGE PROCESS FOR BLEACHING OF PULP WITH AN AQUEOUS HYDROGEN PEROXIDE BLEACHING COMPOSITION CONTAINING MAGNESIUM SULPHATE AND SODIUM SILICATE

[75] Inventors: Gregory J. Siminoski, Ancaster; Tadas S. Macas, West Vancouver, both of Canada

[73] Assignee: C-I-L Inc., North York, Canada

[21] Appl. No.: 289,309

[22] Filed: Dec. 23, 1988

[51] Int. Cl.[4] ..... D21C 9/16

[52] U.S. Cl. ..... 162/78; 162/80

[58] Field of Search ..... 162/78, 80, 24, 71, 162/82

[56] References Cited

U.S. PATENT DOCUMENTS

| | | | |
|---|---|---|---|
| 4,029,543 | 6/1977 | Lindahl | 162/78 |
| 4,462,864 | 7/1984 | Carles et al. | 162/78 |

FOREIGN PATENT DOCUMENTS

| | | | |
|---|---|---|---|
| 783483 | 4/1968 | Canada . | |
| 52-63402 | 5/1977 | Japan | 162/78 |

OTHER PUBLICATIONS

Singh, "The Bleaching of Pulp", TAPPI Press Atlanta, Ga. 1979, pp. 222–279.

Singh, "The Bleaching of Pulp", TAPPI Press Atlanta, Ga., 1979, pp. 275–278.

Strunk, "Factors Affecting Hydrogen Peroxide Bleaching for High-Brightness TMP", *Pulp & Paper,* Jun. 1980 (162–178).

W. Howard Rapson, "Mechanisms of Groundwood Bleaching"; Appita, vol. 23, p. 102 (1969).

D. Lachenal and C. de Choudens, Tappi; 70(3), 119 (1987).

S. Moldenius and B. Sjogren, J. Wood Chem. and Technology; 2(4), 447 (1982).

M. Lundqvist, Svensk Papperstid.; 81(1), 16 (1979).

S. Moldenius, Svensk. Papperstid.; 85(15), R116 (1982).

T. Ali et al., Preprints 72nd Annual Meeting, Technical Section, CPPA; B15 (1986).

P. Joyce and D. Mackie, 1979 International Pulp Bleaching Conference Preprints, Toronto; p. 107.

*Primary Examiner*—Steve Alvo

*Attorney, Agent, or Firm*—C. Brian Barlow

[57] ABSTRACT

A rapid, single stage process for the bleaching of high yield lignocellulose pulp (mechanical pulp) to enhanced brightness levels with hydrogen peroxide in the presence of magnesium sulphate and sodium silicate, with a substantial reduction in the wasteful, non-bleaching reactions of hydrogen peroxide. The residual hydrogen peroxide liquor may be recycled to a pulping or bleaching process.

12 Claims, No Drawings

SINGLE STAGE PROCESS FOR BLEACHING OF PULP WITH AN AQUEOUS HYDROGEN PEROXIDE BLEACHING COMPOSITION CONTAINING MAGNESIUM SULPHATE AND SODIUM SILICATE

This invention relates to a process for the bleaching of wood pulps and more particularly to the bleaching of high-yield lignocellulose pulps with hydrogen peroxide.

High yield lignocellulose pulps that are currently produced include stone groundwood (GWD), thermomechanical pulp (TMP), chemithermomechanical pulp (CTMP), and variations thereon. While these pulps differ somewhat from each other in their methods of production and physical properties they are all classified broadly as mechanical pulps.

Bleaching of mechanical pulps is conventionally a continuous process which usually involves mixing the pulp with a bleaching agent and transferring the mixture to a tower, without further agitation, and allowing the bleaching agent to react in a static fashion with the pulp for a period of time which may be up to 2 hours or longer. The bleaching temperature is usually between 40° C. and 70° C.

Generally, mechanical pulps can be bleached with hydrogen peroxide to brightness levels of 10–12, 13–15 and 16–18 points higher than their initial brightness of 50–60% ISO using peroxide doses of 1%, 2% and 3% (based on the dry weight of pulp), respectively. The brightness gain is very dependent on the wood species and the bleaching conditions. For Eastern Canadian spruce groundwood, a 1% hydrogen peroxide charge yields a brightness increase of about 8–10 points, while a 3% charge can give up to a 18 point brightness increase.

It is known that the brightness gain of a mechanical pulp subjected to hydrogen peroxide bleaching increases with both the amount of hydrogen peroxide applied and the amount of peroxide consumed by the pulp. At low peroxide charges (<2%) the relationship between peroxide applied and brightness gain is nearly linear to a brightness of about 70% ISO. Above this brightness, in the conventional bleaching processes, the brightness gain per unit of hydrogen peroxide applied decreases rapidly. In order to obtain mechanical pulps with enhanced brightnesses of over 80% ISO in a single stage, large amounts of hydrogen peroxide must be applied. Poplar and spruce groundwoods have been reported to have been bleached to 86% and 80.6% ISO respectively using up to 40% hydrogen peroxide on pulp and a two hour retention time. Unfortunately, at these high peroxide charges and long reaction times under conventional conditions, there are wasteful, non-bleaching reactions occurring to a great extent, which contribute significantly to the inefficiency of the process. These wasteful, non-bleaching reactions of hydrogen peroxide include its various decomposition pathways and include the so-called "darkening" reactions.

Hydrogen peroxide bleaching solutions (bleaching liquors) used for mechanical pulps routinely contain several other chemicals in addition to peroxide and water. Other additives include a base, most commonly sodium hydroxide, and hydrogen peroxide stabilizers, most commonly sodium silicate and magnesium sulphate. Also, other stabilizers are available which may be used to replace silicate (and magnesium sulphate) to varying degrees.

Sodium silicate is conventionally used as a commercially available 41° Be solution and is typically applied in the amount of 3 to 4% and sometimes up to 5% (based on dry weight of pulp). Under conventional bleaching conditions, this silicate usage contributes to improving the brightness gain by about 4–5% ISO. Conventionally, magnesium sulphate is used in the storage of hydrogen peroxide bleaching solutions. It has been shown to stabilize such bleaching liquors. The common use of magnesium sulphate in bleaching per se has stemed from this prior usage. Typically, magnesium sulphate is used in the amount of 0.05% (based on dry weight of pulp).

It has been suggested (1979 International Pulp Bleaching Conference Preprints, CPPA, Toronto, Canada, P. 107), that optimum mechanical pulp brightening occurs when equal proportions of sodium hydroxide and hydrogen peroxide (by weight) are applied on the pulp. However, these proportions of chemicals are not necessarily applicable to all mechanical pulp types or wood species, and deviations from this suggested ratio are quite common. A typical application of sodium hydroxide for 1% (on pulp) hydrogen peroxide is about 1.5% (on pulp), normally resulting in an initial pH of 10.5–11.0 in the pulp slurry.

Best bleaching results have been suggested to be obtained when at least 10% of the original charge of the sodium hydroxide (Pulp and Paper, 54(6), 156 (1980)) and 30–40% of the initial peroxide added remains after the bleach is completed (Preprints 72nd Annual Meeting, Technical Section Can. Pulp and Paper Assoc., B15 (1986)). This implies a total consumption of hydrogen peroxide in the range of 60–70%.

The stoichiometry of the reaction of peroxide with spruce groundwood has been investigated at 15% consistency (Svensk Papperstid., 85(15), R116 (1982)). This was accomplished by monitoring the decrease in the light absorption coefficient of the pulp, rather than an increase in the brightness. The purpose of these experiments was to show the optimum bleaching conditions for hydrogen peroxide on mechanical pulp. It was suggested that a fine balance between the amounts of hydrogen peroxide and sodium hydroxide in the bleach liquor existed. It was shown that an increase in the applied peroxide charge, up to 6% peroxide (on pulp), lowers the pH where bleaching is most efficient. This was determined from the decrease in the light absorption coefficient of the pulp for a given peroxide consumption. Stoichiometrically, it was found that at 1% hydrogen peroxide, a pH of 10.7–11.5 provided optimum efficiency, while at 6% hydrogen peroxide a pH of 10.3–10.7 was best. Above these optimal pH ranges, bleaching was less efficient as noted by peroxide decomposition and alkali darkening reactions. No mention of final pulp brightnesses was made.

The kinetics of peroxide bleaching of mechanical pulp have been investigated by studying the rate of chromophore elimination (Svensk Papperstid., 81(1), 16 (1979)). The concentration of chromophores was approximated using the light absorption coefficient calculated according to the Kubelka-Munk equation. At a constant pH (in the range 9.0–11.5) and a constant hydrogen peroxide concentration (using 16.6–200% on pulp), it was found that the bleaching rate was proportional to the applied hydrogen peroxide concentration. However, in this study no correlation was made with current industry practice of bleaching at 10–15% consistency. Further, this study set out to determine whether sodium silicate and magnesium sulphate influenced the rate of hydrogen peroxide bleaching. It was found that there was no positive effect with magnesium sulphate and only a small effect with sodium silicate.

In a similar kinetic study (J. Wood Chem. and Tech., 2(4), 447 (1982)), again, the pH and peroxide concentrations were kept constant. However, the final brightness of the pulp and chemical consumption were not discussed.

Bleaching of groundwood mechanical pulp to a high brightness (Tappi, 70(3), 119 (1987)) has been demonstrated using 10% hydrogen peroxide (on pulp). It was found that at least one hour was required to reach 80% ISO and that higher brightness could only be achieved when the retention time was extended to four hours or more. At a retention time of 16 hours, a brightness of 85.0% ISO was reached and 7.2% hydrogen peroxide (on pulp) was consumed.

Canadian Patent No. 783,483 in the name of Electric Reduction Company of Canada Ltd. which issued April 23, 1968, describes a dynamic process for the bleaching of cellulosic fibres wherein the bleaching solution is passed through a bed of relatively stationary fibres to produce a much reduced bleaching time over that required for the conventional static processes. In this dynamic bleaching process the pulp is exposed to the bleaching reagent as the water in the pulp is displaced by the advancing bleaching chemical front. An advantage provided by this process is the reduction in the bleaching contact time while the bleaching solutions are typically those of use in conventional static bleaching processes.

We have now discovered that wood pulp, and in particular mechanical pulp as defined hereinabove, can be rapidly bleached to enhanced brightness levels with hydrogen peroxide in the presence of sodium silicate and magnesium sulphate with a substantial reduction in the wasteful, non-bleaching reactions of hydrogen peroxide. The residual or spent hydrogen peroxide liquor can be recycled to a pulping or bleaching process. The brightness level achievable is greater than or equal to 80% ISO and thus provides enhanced brightness.

It is an object of the present invention to provide a process that enables mechanical pulps to be bleached to a brightness level greater than or equal to 80% ISO (enhanced brightness).

It is a further object to provide a bleaching process wherein the wasteful non-bleaching reactions of the bleaching agent, hydrogen peroxide, are significantly reduced in comparison to conventional bleaching processes at similar brightness.

It is yet a further object to provide a process that allows mechanical pulps to be bleached to greater than or equal to 80% ISO (enhanced brightness) in as little as five minutes.

Accordingly, in one aspect, the invention provides a rapid single stage process for the bleaching of mechanical pulp, said process comprising treating said pulp at a pH selected from the range of about 9 to about 11 in an aqueous bleaching composition comprising greater than about 10 percent (weight by weight (w/w) on pulp) of hydrogen peroxide, and magnesium sulphate and sodium silicate and a base in ratios and sufficient amounts to substantially reduce the wasteful, non-bleaching reactions of hydrogen peroxide; and for a sufficient period of time to effect enhanced brightness of said pulp; and to produce a pulp of said enhanced brightness and a residual liquor.

The aqueous bleaching composition, according to the process of the present invention, comprises unusually large charges of hydrogen peroxide on pulp—at least greater than about 10% w/w and preferably greater than about 20% w/w. More preferably, the aqueous bleaching composition comprises from about 20 percent to about 200 percent (w/w on pulp) of hydrogen peroxide.

Further, according to the process of the present invention, magnesium sulphate and sodium silicate together with base and the hydrogen peroxide are used in ratios and sufficient amounts to substantially reduce the wasteful, non-bleaching reactions of hydrogen peroxide. Preferably the amount of magnesium sulphate is greater than or equal to about 0.2 percent on pulp and more preferably from about 0.2 to about 2 percent on pulp.

Preferably, the ratio of hydrogen peroxide:sodium silicate is from about 1 to about 6 and the ratio of sodium silicate: base (the base being on a sodium hydroxide basis) is from about 1 to about 4.

In a further aspect of the process of the present invention, the treatment of said pulp is for a sufficient period of time to effect enhanced brightness of the pulp. Preferably the time is less than about 30 minutes. More preferably, less than about 15 minutes.

Optionally, the process of the present invention is carried out in a dynamic fashion by passing a continuous flow of bleaching liquor through a bed of mechanical pulp fibres, comprising the pulp, under conditions as hereinbefore defined.

The process according to the present invention produces a pulp of enhanced brightness and a residual liquor, said process characterized by a substantial reduction in the wasteful, non-bleaching reactions of hydrogen peroxide, as hereinbefore discussed, in the treatment that produces a pulp of enhanced brightness. Therefore, the residual liquor remaining at the end of the treatment contains a substantial amount of the initial hydrogen peroxide charge (the residual hydrogen peroxide). Therefore, in a still yet further aspect of the process of the present invention, the residual liquor is recycled to a pulping or bleaching process.

Not to be bound by theory, the reduced hydrogen peroxide consumption reflects the reduction in hydrogen peroxide decomposition during the bleaching process. Hydrogen peroxide decomposition consists of undesired side reactions that are detrimental and significantly contribute to the inefficient use of the bleaching reagent. Therefore, the application of the combination of magnesium sulphate and sodium silicate together with base in ratios and sufficient amounts may be considered to stabilize the hydrogen peroxide (reduce the hydrogen peroxide decomposition) and provide more efficient bleaching to effect enhanced brightness of the pulp.

In the process according to the preset invention, the treatment of pulp is carried out at a pulp consistency of 8–25% and preferably at a pulp consistency of 10–15%; and at a temperature of from about 50° C. to about 90° C. for preferably less than about 30 minutes, and more preferably less than about 15 minutes. Treatment times as short as 5 about minutes can produce pulps of enhanced brightness.

The pulps of enhanced brightness in the process attain brightness levels as high as 89% ISO and the total hydrogen peroxide consumption does not exceed about 8% by weight on pulp.

The hydrogen peroxide charge is at least greater than about 10% w/w on pulp and preferably greater than about 20% w/w. More preferably, the charges are from about 20% to about 200% w/w on pulp, and still more preferably from about 20% to 60% w/w on pulp.

The advantages provided by the process according to the present invention include: (1) increased pulp throughout as a result of the reduced pulp treatment time; (2) production of pulps of brightness greater than 80% ISO with substantially reduced hydrogen peroxide consumption; (3) the opportunity of recycling spent liquor in order to vastly improve upon the economics of producing pulps of enhanced brightness levels.

AS with conventional bleaching, it is recommended that a pretreatment of the pulp with a chelating agent such as DTPA (diethylenetriaminepentaacetate) be included.

Preferred embodiments of the present invention will now be illustrated by way of examples.

EXAMPLE 1

An Eastern Canadian softwood groundwood pulp (50 g oven-dried weight, 62.2% ISO brightness) was treated with an aqueous composition containing 53.6% (by weight on pulp) of 100% hydrogen peroxide, 18% (by weight on pulp) of 41°Be sodium silicate, 0.54% (by weight on pulp) of magnesium sulphate and 10% (by weight on pulp) of sodium hydroxide. The pulp slurry at 10% consistency was thoroughly mixed and then heated in a polyethylene bag at 70° C. for 30 minutes in a static fashion. After this time period, residual liquor was separated from the pulp by suction filtration and/or pressing. The hydrogen peroxide consumed was calculated from the amount of residual hydrogen peroxide, which was determined from a portion of the residual liquor. Following filtration, the pulp was washed once with water. The initial pH of the pulp slurry before bleaching was 10.7 and after bleaching 10.4 The final brightness of the pulp was 87.4% ISO. The hydrogen peroxide consumption was 6.6% on pulp.

EXAMPLE 2

The process of Example 1, wherein the chemical charges and results are listed in Table 1.

TABLE 1

| HYDROGEN PEROXIDE (% ON PULP) | SODIUM HYDROXIDE (% ON PULP) | SODIUM SILICATE (41° Be) | MAGNESIUM SULPHATE (% ON PULP) | INITIAL pH | BRIGHTNESS (% ISO) | HYDROGEN PEROXIDE CONSUMED (% ON PULP) |
|---|---|---|---|---|---|---|
| 19 | 3.5 | 6 | 0.54 | 9.7 | 83.3 | 3.8 |
| 27 | 5 | 9 | 0.54 | 10.0 | 84.4 | 3.8 |
| 54 | 16 | 18 | 0.54 | 10.1 | 84.4 | 7.5 |
| 106 | 20 | 36 | 0.54 | 10.0 | 84.2 | 4.5 |
| 53* | 10 | 18 | 0.54 | 10.7 | 84.9 | 5.1 |

*Time is 10 minutes

EXAMPLE 3

For comparison, this example illustrates the use of high hydrogen peroxide charge with conventional amounts of sodium silicate and magnesium sulphate present as stabilizers. Although the enhanced brightness was achieved, the consumption of peroxide is outside the teaching of the present invention.

An Eastern Canadian softwood groundwood pulp (50 g oven-dried weight, 62.2% ISO brightness) was treated with an aqueous composition containing 52% (by weight on pulp) of 100% hydrogen peroxide, 4% (by weight on pulp) of 41°Be sodium silicate, 0.04% (by weight on pulp) of magnesium sulphate and 10% (by weight on pulp) of sodium hydroxide. The pulp slurry at 10% consistency was thoroughly mixed and heated in a polyethylene bag at 70° C. for 30 minutes in a static fashion. The initial pH of the pulp slurry before bleaching was 10.8 and after bleaching 10.7. The final brightness of the pulp was 86.7% ISO. The hydrogen peroxide consumption was 30% on pulp.

EXAMPLE 4

This example illustrates the preferred process comprising a continuous flow according to the invention:

An Eastern Canadian softwood groundwood pulp (50 g oven-dried weight, 62.2% ISO brightness) at 10% consistency was packed into a water-jacketed column and heated to 70° C. Bleaching was accomplished in a dynamic fashion by percolating a solution (500 mL) containing 18% (by weight on pulp) of 41°Be sodium silicate, 0.54% (by weight on pulp) of magnesium sulphate, 10% (by weight on pulp) of sodium hydroxide and 53.6% (by weight on pulp) of 100% hydrogen peroxide through the pulp bed over a period of 10 minutes. This was followed by a hot water wash (500 mL) in a similar dynamic fashion. The resulting pH of the liquor before bleaching was 9.8, and after bleaching, 9.9. The bleached pulp had a brightness of 86.4% ISO. The amount of hydrogen peroxide consumed was 6.1% on pulp. The ratio of initial hydrogen peroxide to silicate was ~3; the ratio of silicate to base was ~1.8.

EXAMPLE 5

The process of Example 4, wherein the chemical charges and results are listed in Table 2.

TABLE 2

| TIME (MINUTES) | HYDROGEN PEROXIDE (% ON PULP) | SODIUM HYDROXIDE (% ON PULP) | SODIUM SILICATE 41° Be (% ON PULP) | MAGNESIUM SULPHATE (% ON PULP) | INITIAL pH | BRIGHTNESS (% ISO) | HYDROGEN PEROXIDE CONSUMED (% ON PULP) |
|---|---|---|---|---|---|---|---|
| 10 | 54 | 16 | 18 | 0.54 | 10.3 | 84.4 | 7.4 |
| 10 | 53 | 30 | 72 | 0.54 | 10.9 | 84.9 | 5.6 |
| 15 | 104 | 20 | 36 | 1.1 | 10.1 | 84.5 | 4.5 |
| 15 | 104 | 20 | 36 | 0.72 | 10.1 | 84.1 | 5.2 |
| 15 | 104 | 20 | 36 | 0.36 | 10.1 | 84.5 | 5.6 |
| 15 | 104 | 6 | 18 | 0.54 | 9.5 | 82.8 | 3.1 |

TABLE 2-continued

| TIME (MINUTES) | HYDROGEN PEROXIDE (% ON PULP) | SODIUM HYDROXIDE (% ON PULP) | SODIUM SILICATE 41° Be (% ON PULP) | MAGNESIUM SULPHATE (% ON PULP) | INITIAL pH | BRIGHTNESS (% ISO) | HYDROGEN PEROXIDE CONSUMED (% ON PULP) |
|---|---|---|---|---|---|---|---|
| 15 | 104 | 8 | 18 | 0.54 | 9.7 | 83.6 | 4.4 |
| 15 | 104 | 10 | 18 | 0.54 | 9.7 | 83.7 | 4.1 |
| 15 | 104 | 14 | 18 | 0.54 | 9.8 | 84.2 | 5.0 |
| 15 | 104 | 16 | 18 | 0.54 | 9.9 | 84.0 | 5.0 |
| 15 | 104 | 20 | 36 | 0.54 | 10.0 | 85.1 | 6.2 |

EXAMPLE 6

For comparison, this example uses no magnesium sulphate. Although the enhanced brightness was achieved, the consumption of peroxide is outside the teachings of the present invention.

The process of Example 4 was employed, wherein the percolating solution contained no magnesium sulphate, 36% (by weight on pulp) of 41°Be sodium silicate, 104% (by weight on pulp) of 100% hydrogen peroxide and 20% (by weight on pulp) of sodium hydroxide. The time was 15 minutes. The resulting pH of the liquor before bleaching was 10.1. The bleached pulp had a brightness of 84.2% ISO. However, the amount of hydrogen peroxide consumed was 13.4% on pulp.

EXAMPLE 7

The process of Example 4 except the pulp was a cottonwood groundwood. The starting brightness was 59.1% ISO. The pH of the bleaching liquor was 10.1 and after bleaching 10.5. The bleached pulp had a final brightness of 83.8% ISO. The consumption of hydrogen peroxide was 3.6% on pulp.

The data listed in Table 1, Example 2, illustrates the effectiveness of the process according to the present invention for bleaching a groundwood pulp in a static fashion in 30 minutes or less. Brightness levels above 80% ISO (and as high as 84.9% ISO) are attained rapidly and for a range of chemical charges, that is for hydrogen peroxide charges from 19% to 106% on pulp, and the hydrogen peroxide consumption is less than 8% on pulp. For comparison, Example 3 illustrates the use of a high hydrogen peroxide charge with conventional amounts of sodium silicate and magnesium sulphate. In this Example, although a brightness of 86.7% ISO was attained, the hydrogen peroxide consumption was 30% of pulp.

The data listed in Table 2, Example 5, illustrates the effectiveness of the process according to the present invention for bleaching a groundwood pulp in a dynamic fashion in 15 minutes or less. Brightness levels above 80% ISO are attained rapidly and for a range of chemical charges and the hydrogen peroxide consumption is less than 8% on pulp. For comparison, Example 6 illustrates the necessity for magnesium sulphate to be included in the process of the present invention, in that although a brightness of 83.8% ISO was attained, the hydrogen peroxide consumption was 13.4% on pulp.

Therefore, it can be seen that the process according to the present invention produces a pulp of enhanced brightness, rapidly, with a substantial reduction in hydrogen peroxide consumption.

The embodiments of the invention in which an exclusive property or privilege is claimed are defined as follows:

1. A rapid, single stage process for the bleaching of mechanical pulp, said process comprising treating said pulp at a pH selected from the range of about 9 to about 11 in an aqueous bleaching composition comprising greater than about 10 percent by weight on pulp of hydrogen peroxide, magnesium sulphate in an amount greater than or equal to about 0.2 percent by weight on pulp, sodium silicate in an amount equal to or greater than 6 percent by weight on pulp and a base, wherein the hydrogen peroxide, magnesium sulphate, sodium silicate and base are in ratios and in sufficient amounts to reduce the wasteful non-bleaching reactions of the hydrogen peroxide; and for a sufficient period of time to effect enhanced brightness of said pulp; and to produce a pulp of said enhanced brightness and a residual liquor.

2. A process as claimed in claim 1, wherein the amount of magnesium sulphate is from about 0.2 percent to about 2 percent by weight on pulp.

3. A process as claimed in claim 1 wherein said amounts of hydrogen peroxide and sodium silicate are in a ratio selected in the range from about 1 to about 6.

4. A process as claimed in any one of claims 1 to 3 wherein said amounts of sodium silicate and base, said base defined on a sodium hydroxide basis, are in a ratio selected in the range from about 1 to about 4.

5. A process as claimed in claim 1, wherein the aqueous bleaching composition comprises greater than about 20 percent by weight on pulp of hydrogen peroxide.

6. A process as claimed in claim 1, wherein the aqueous bleaching composition comprises from about 20 percent to about 200 percent by weight on pulp of hydrogen peroxide.

7. A process as claimed in claim 1, wherein the period of time to effect enhanced brightness is less than about 30 minutes.

8. A process as claimed in claim 1, wherein the period of time to effect enhanced brightness is less than about 15 minutes.

9. A process as claimed in claim 1, wherein the treatment of said pulp is carried out at a pulp consistency of about 8–25 percent.

10. A process as claimed in claim 1, wherein the treatment of said pulp is carried out at a temperature of about 50°–90° C.

11. A process as claimed in claim 1, wherein said treatment comprises passing a continuous flow of said aqueous bleaching composition through a bed of said mechanical pulp.

12. A process as claimed in claim 1 or claim 11, wherein the residual liquor is recycled to a pulping or bleaching process.

* * * * *